United States Patent [19]

Rasmussen

[11] Patent Number: 4,818,147

[45] Date of Patent: Apr. 4, 1989

[54] TENDON FOR ANCHORING A SEMISUBMERSIBLE PLATFORM

[75] Inventor: Jens Rasmussen, Partille, Sweden

[73] Assignee: Gotaverken Arendal AB, Goteborg, Sweden

[21] Appl. No.: 114,763

[22] Filed: Oct. 30, 1987

[30] Foreign Application Priority Data

Nov. 12, 1986 [SE] Sweden ..... 8604835

[51] Int. Cl.[4] ..... E02B 17/00; B63B 21/50

[52] U.S. Cl. ..... 405/224; 166/355; 175/7; 405/195

[58] Field of Search ..... 405/224, 205, 206, 195, 405/202; 166/338, 355, 340, 341

[56] References Cited

U.S. PATENT DOCUMENTS

| | | | |
|---|---|---|---|
| 4,226,555 | 10/1980 | Bourne et al. | 405/224 |
| 4,320,993 | 3/1982 | Hunter | 405/224 |
| 4,351,258 | 9/1982 | Ray et al. . | |
| 4,391,554 | 7/1983 | Jones | 405/224 |
| 4,516,882 | 5/1985 | Brewer et al. | 405/205 X |

FOREIGN PATENT DOCUMENTS

| | | |
|---|---|---|
| 045613 | 2/1982 | European Pat. Off. . |
| 189671 | 8/1986 | European Pat. Off. . |
| 191992 | 8/1986 | European Pat. Off. . |
| 153683 | 1/1986 | Norway . |
| 153840 | 2/1986 | Norway . |

*Primary Examiner*—Dennis L. Taylor

*Attorney, Agent, or Firm*—Wegner & Bretschneider

[57] ABSTRACT

A tendon installation for anchoring a semisubmersible platform to a sea bed foundation, wherein said tendons are tensioned by the updrift of the platform. The tendons are prefabricated in dimensions adpated to the depth of the sea bed foundation, expected tension load and in order to be substantially weightless in water. The tendons are connected in groups at each of their ends at a distance corresponding to the distance between anchoring points in the foundation and the platform respectively. The groups of tendons are towed out to the anchoring site and they are positioned vertically above the foundation. The tendons are fastened to the anchoring points in the foundation. The platform is positioned above the groups of tendons and connected to these via wire ropes. The platform is ballasted down onto the tendons under guidance by said wire ropes. The upper ends of the tendons are mounted internally in the legs of the platform. There is only one elastic load bearing connection means between the platform and each tendon, said connection means being remotely adjustable.

3 Claims, 6 Drawing Sheets

TENDON FOR ANCHORING A SEMISUBMERSIBLE PLATFORM

FIELD OF THE INVENTION

The present invention relates to a tendon for anchoring a semisubmersible platform to a sea bed foundation.

BACKGROUND OF THE INVENTION

It is known to anchor platforms for offshore production of oil and gas at sea bed foundations, via stiff steel pipes which are pretensioned by the buoyancy of the platform. These platforms are usually called "Tension Leg Platforms" and provide substantial advantages in deep sea, e.g. over 300 m. In these depths the costs for a non-floating installation standing on the seabed will be very high. On the other hand, the sea bed installations (template, B.O.P. etc.) for a normal, flexibly anchored semisubmersible production platform will be expensive and more exposed to corrosion and wear, and the riser lines must also be flexible.

Since a submersible platform with a tension leg anchoring system can have a considerable buoyancy, it will not be affected by the prevailing sea heave, and conventional stiff riser lines may be used. Thereby the sea bed installations can be simplified and equipment may be accessibly installed on the deck of the platform.

In prior art TLP-installations, the production platform is placed in position above its foundation and the tendons are lowered in the same manner as a drill string, wherein each string must "target" its connection point in the foundation. This complicate installation procedure normally takes several days and requires good weather with minimal heave and substantial assistance from well anchored, stable barge ships acting as motion stabilizers.

SUMMARY OF THE INVENTION

The object of the invention is to provide a better tendon for installation of a tension leg platform, which enables the installation to be performed in short time and with little assistance.

The tendon installation according to the invention comprises placing the anchoring points for the tendons at the platform internally in the legs, at the level of the pontoons, and providing a single elastic load bearing connection means between the platform and each tendon, said connection means being remotely adjustable.

According to one preferable embodiment of the invention, the connection means comprise a sleeve nut which is adjustable along the upper end of the tendon and in engagement with a rotation means.

The tendon is preferably connected to the foundation via elastical screw joints.

Further, tendons situated at the respective corners of the platform are preferably connected in groups until they have been towed out to the foundation site and been installed to the foundation and said platform.

BRIEF DESCRIPTION OF THE DRAWINGS

The invention will now be described in detail with reference to the accompanying drawings, in which.

DESCRIPTION OF A PREFERRED EMBODIMENT

After completion of the prospecting of an oil well, the well holes needed for production are drilled and connected to a well head on the sea bed. A foundation 10 (see FIG. 2) is also anchored adjacently said well head by means of piles driven into the bottom sediment.

Figure 1:
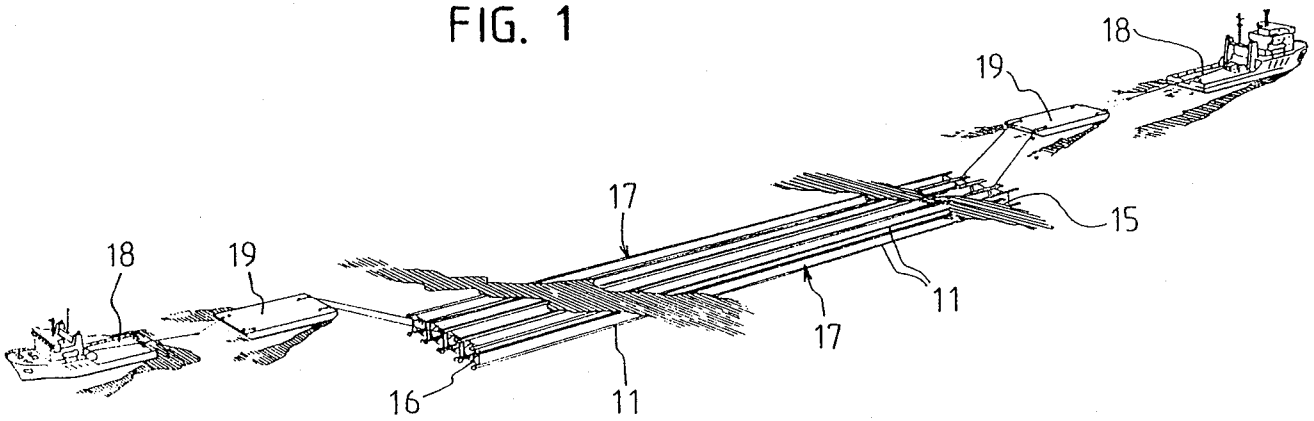
FIG. 1 shows the tendons being towed to the installation site.

Meanwhile a preproduction of tendons 11 is started within a dry dock or similar production facility. The tendons are welded together from proportionately thin walled pipe pieces having a large diameter, into a length sufficient to overlap the distance between the foundation 10 and a production platform situated vertically above it. The elements are provided with a flexible screw joint 12 in the lower end, and in the upper end a rigid end section 13 having an outer thread and a dismountable sealing cap, said cap enabling internal inspection of the tendon after installation. The tendons are protected against corrosion and connected in parallel, e.g. four and four by means of an upper and a lower rectangular frame 15 and 16 respectively. After launching, four groups 17 of four tendons 11 are towed by tugs 18 as FIG. 1 show, out to the foundation site, hanging in barges 19.

Figure 3:
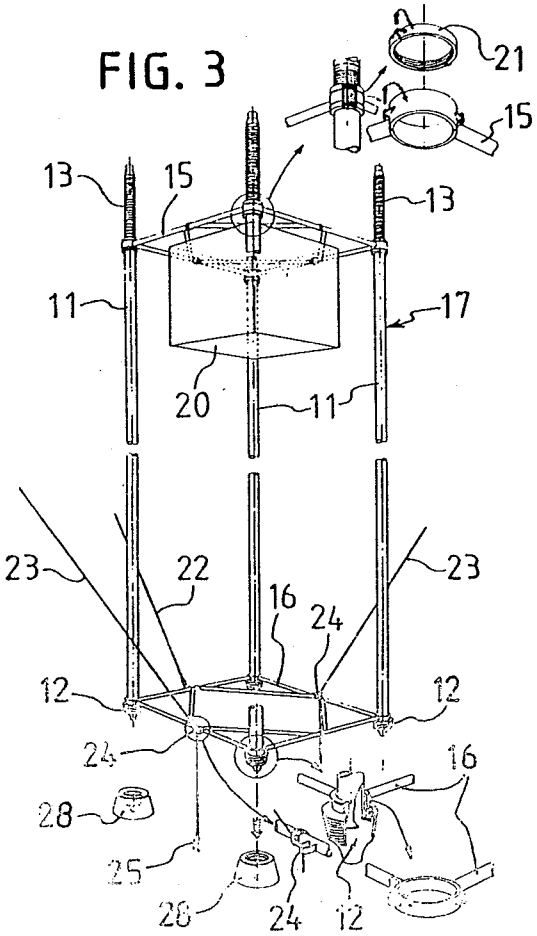
FIG. 3 shows the group in FIG. 2 in larger scale.

FIG. 3 shows how one of these groups is composed, and it appears that the upper frame 15 has a ballastable float 20 and is connected to the end sections 13 outer threads via dismountable nut segments 21.

Figure 2:
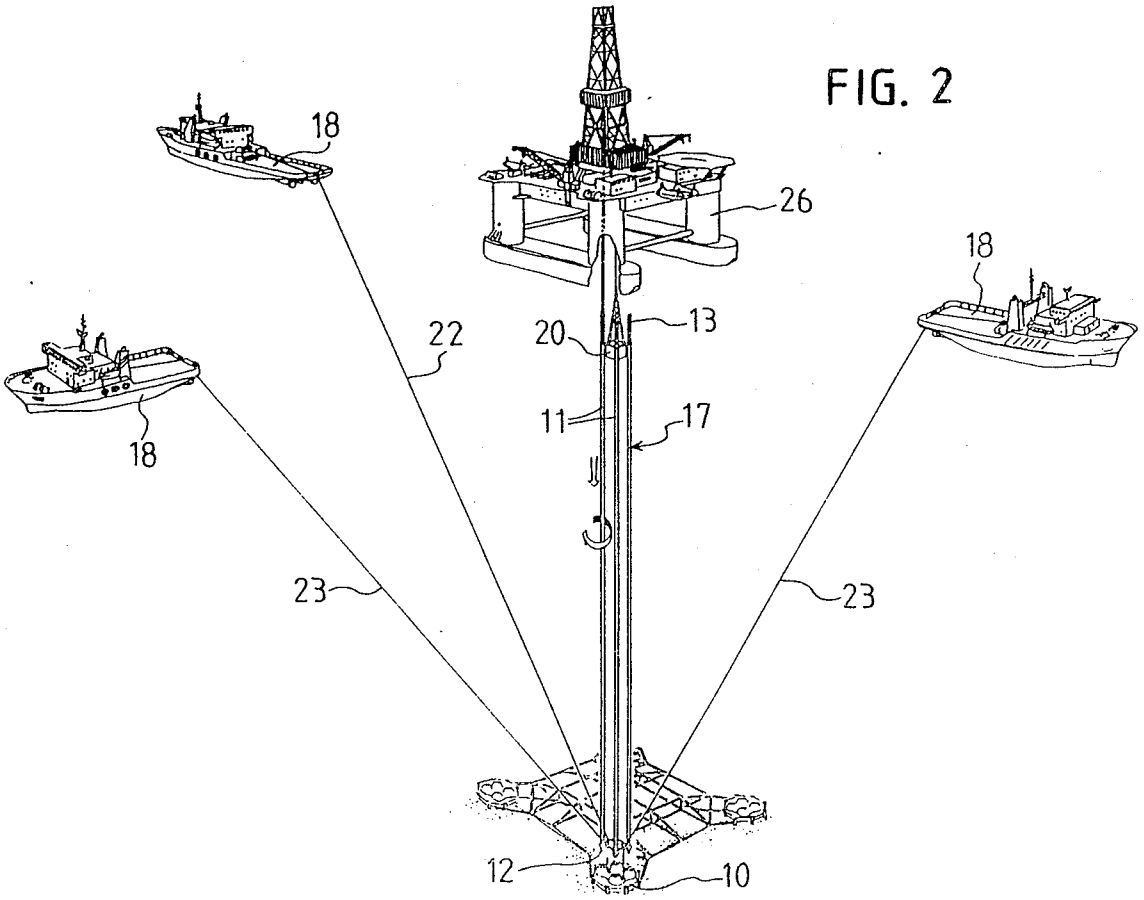
FIG. 2 shows a group of tendons being installed.
Figure 4:
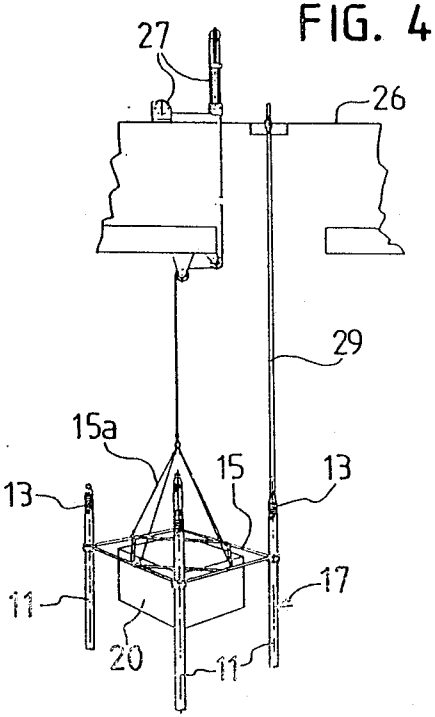
FIG. 4 is a diagrammatical view showing the application of a rotation tool at the tendons, during installation.

Each group of tendons normally has a certain negative buoyancy necessitating the barges 19. When the foundation site is reached, a wire rope 22 is connected to the lower frame 16. Further wire ropes 23 connected to eyelets 25 in the foundation 10 are led through an eyes 24 in the frame 16. Each of these wire ropes are connected to a tug 18 as FIG. 2 shows. The upper frame 15 is connected via a crowfoot 15a to a semisubmersible drill platform 26, which has dynamic positioning means and heave compensating winch means 27 (see FIG. 4).

Through the cooperation of these units 18, 26, the group 17 of tendons may be pivoted to a vertical position above the foundation 11. By means of the wire ropes 23, the bottom end of the of said group may be guided to an exact position above four anchor points 28 in the foundation 10. Known acoustic means may be used to measure the exact vertical distance between the connectors 12 and the anchor points 28. When the tendons are in the proper position, the group 17 is lowered by means of the heave compensating winches 27 into the anchor points 28.

Figure 5:
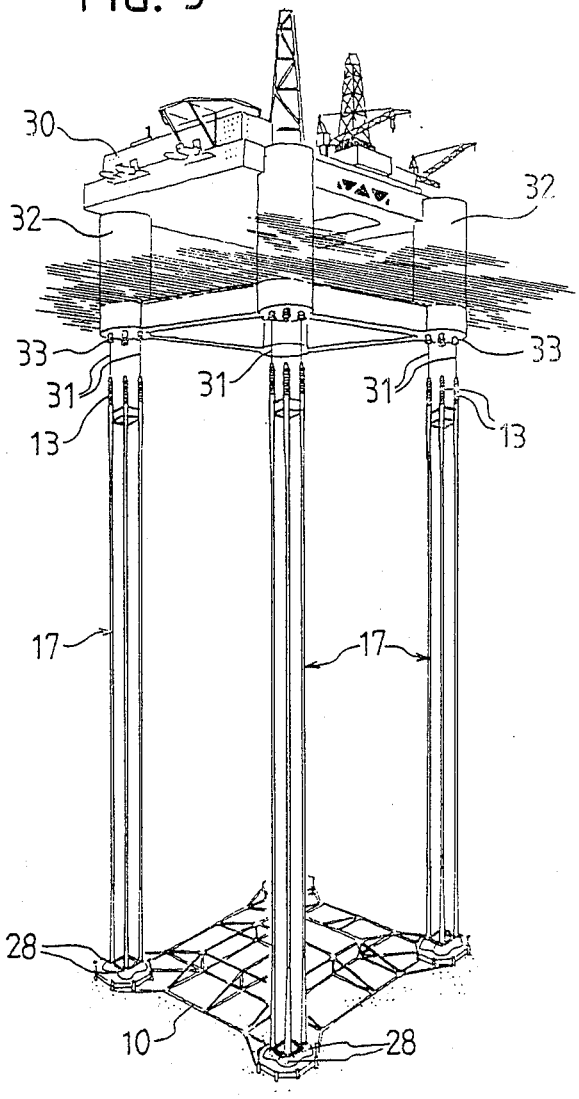
FIG. 5 shows a production platform during attachment to the tendons.

At this moment a rotation means 29 is applied to one of the end sections 13 of the group and the equipment on the drill platform 26 for driving a drill string is used for turning the tendon, until the screw connection 12 in the opposite end is locked into the anchor point 28. Then the rotation means is disconnected and applied to the next tendon in the group, by rotation of the platform 26 a quarter of a turn. This procedure is repeated until all of the tendons 11 in all of the four groups 17 are installed, as FIG. 5 shows. Air is introduced into the float 20 and a marker buoy is connected to the upper ends of two diagonally opposed tendons in each group, whereafter the drill platform is ready to leave the installation site.

A production platform 30 is now or at any later convenient time towed to the foundation site and over the vertically standing tendons 11. Wire ropes 31 are connected to the connection points of the above mentioned buoys in each group 17, said ropes 31 being connected to heave compensating winch means (not shown) in the four vertical legs 32 of the platform.

When the platform is in exactly the right position full pulling power is applied to all wires 31 while the platform is ballasted. This causes the platform to lower itself onto the tendons who are pulled in through ports 33 at the bottom of each leg.

Figure 6:
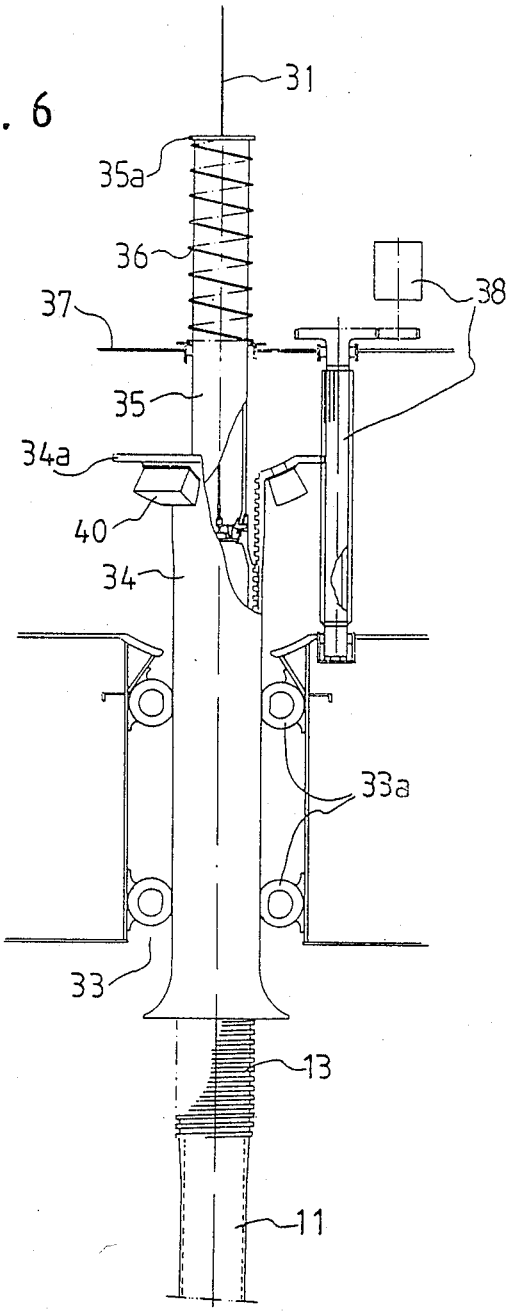
FIG. 6 shows equipment within the platform, for attachment of the upper tendon ends.
Figure 7:
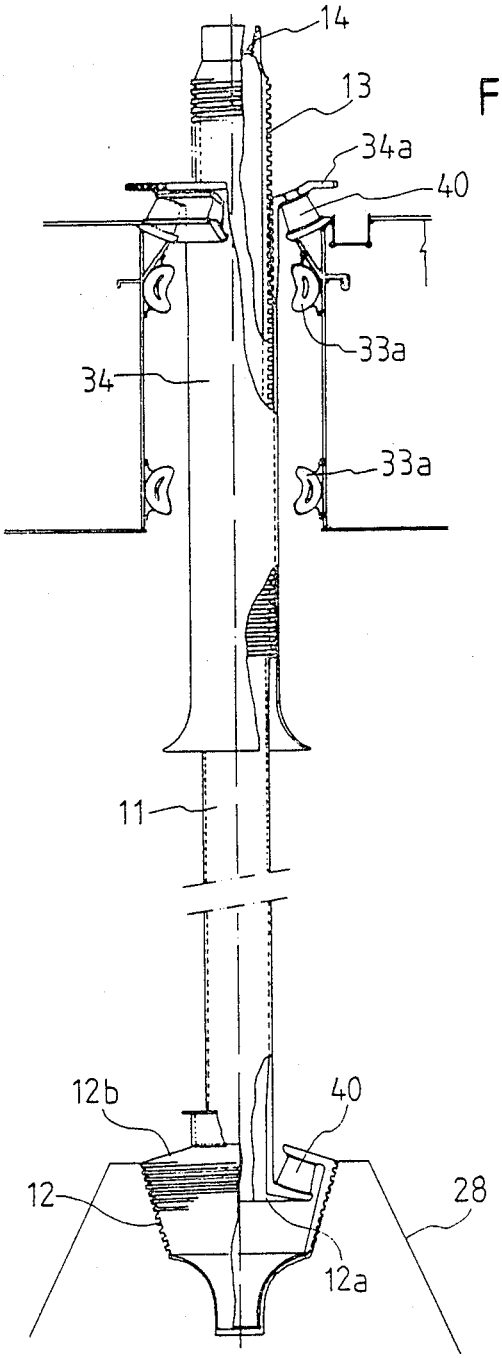
FIG. 7 shows an installed tendon.

FIG. 6 and 7 show such a port 33, in which the end section 13 of a tendon intrudes. Ring elements 33a of elastic material in the port 33 hold a nut sleeve 34, which initially abuts the end section 13. An extension element 35 is mounted as an elongation of the end section and has a helical spring 36. A head 35a on the extension element forms a support for the spring 36 which bears with its opposite end against a surface 37 on the platform leg 32. The extension element 35 enables the application of tension on the tendon 11 via the spring 36, by a certain reduction of ballast in the platform, wherein the spring 36 allows for elastic heave compensation.

As soon as the above described device has been mounted on all sixteen tendons 11 said reduction of ballast may be performed. Now the nut sleeve 34 may be rotated along its thread downward to a suitable position, by means of a gear drive means 38 which is in engagement with a peripheral gear ring 34a on the nut sleeve 34. Hereafter the ballast in the platform 30 may be further reduced until the normal buoyancy is achieved. Now the extension element 35 and the spring 36 may be dismounted, since heave compensation not longer is necessary. The floats 20 may now be ballasted and the upper frames can be removed. Final adjustment of the tendon tension can be performed via the gear drive means 38. The ring elements **33*a* are deflated, so that the tendons 11 may be slightly angled in relation to the platform. This is facilitated by a ring 40 of elastic material onto which the peripheral part 34*a* of the nut sleeve bears. Corresponding rings 40 lends flexibility to the screw joints 12 at the opposite ends of the elements. A collar 12*a* formed on the end of the tendon 11 is surrounded by a cup shaped element 12*b* which is externally threaded and gripped by the collar 12*a* via the elastic ring 40**.

The entire above described installation may be performed without assistance from divers. Fastening and release of wire ropes may be done with help from remotely operated vehicles. The operation is preferably performed in two steps, i.e.

step 1: installation of tendons, and step 2: installation of platform, wherein the anchoring of the platform may be performed in a few hours.

Release of the platform from the foundation may be done in the opposite way, e.g. when the oil well is empty, or for exchange of a tendon.

The above described method enables the use of an optimal production platform, which can be fabricated at low cost, since it does not need to carry tendon sections or means for their installation. Since the tendons can be prefabricated in full length without joints, they can be made with less weight, so that the total design gives low deadweight stresses and low load imposed on platform, simplifying construction.

The invention is not limited to the above described embodiment, but several modifications are possible within the scope of the embodying claims. For example, the flexible end couplings may be differently designed. The tendons may be designed in many ways, e.g. with varying diameter along their length.

What we claim:

1. A tendon installation apparatus for anchoring a semisubmersible platform to a sea bed foundation, comprising substantially vertical legs and horizontal pontoons of said platform; a generally rectangular frame which is connected to said horizontal pontoons via said legs; tendons which run substantially vertically between said foundation and the corners of said frame; anchoring points for the tendons connected internally in the legs at a level of the platform, and at the level of the pontoons; and a single elastic load bearing connection means which is remotely adjustable between said platform and each of said tendon.

2. A tendon installation apparatus, according to claim 1, wherein the connection means comprises a sleeve nut which is adjustable along an upper end portion of the tendon and in engagement with a rotation means for engaging said tendon into said sleeve nut.

3. A tendon installation apparatus, according to claim 1, wherein said tendons situated at respective corners of said platform are connected in groups while being towed out to a foundation site, and until said tendons have been installed to said foundation and said platform.

* * * * *